US005347963A

United States Patent [19]

Chung

[11] Patent Number: 5,347,963

[45] Date of Patent: Sep. 20, 1994

[54] LASH ADJUSTMENT SYSTEM FOR AN INTERNAL COMBUSTION ENGINE

[75] Inventor: Inhwa Chung, Kyungki-do, Rep. of Korea

[73] Assignee: Hyundai Motor Company, Seoul, Rep. of Korea

[21] Appl. No.: 159,362

[22] Filed: Nov. 30, 1993

[30] Foreign Application Priority Data

Jul. 23, 1993 [KR] Rep. of Korea ..... 93-14035

[51] Int. Cl.[5] ..... F01L 1/24

[52] U.S. Cl. ..... 123/90.46; 123/90.55

[58] Field of Search ..... 123/90.27, 90.39, 90.43, 123/90.45, 90.46, 90.52, 90.55, 90.57

[56] References Cited

U.S. PATENT DOCUMENTS

| | | | |
|---|---|---|---|
| 4,649,874 | 3/1987 | Sonoda et al. | 123/90.27 |
| 4,739,734 | 4/1988 | Honda et al. | 123/90.46 |
| 4,741,301 | 5/1988 | Patterson | 123/90.46 |
| 4,903,651 | 2/1990 | Matsuura et al. | 123/90.46 |
| 4,941,438 | 7/1990 | Muto | 123/90.46 |

*Primary Examiner*—E. Rollins Cross
*Assistant Examiner*—Weilun Lo
*Attorney, Agent, or Firm*—Birch, Stewart, Kolasch & Birch

[57] ABSTRACT

A lash adjusting system for internal combustion engines which can adjust valve clearances of intake and exhaust valves by only one lash adjuster, in which the lash adjusting system for a combustion engine having a cylinder head and a valve train for opening or closing an intake valve or an exhaust valve including a guide member fixed on the cylinder head and having openings at its both ends; a pair of plungers slidably disposed in the guide member, the plungers applying a force in opposite direction of each other respectively; a pair of levers respectively receiving a force from one of the plungers and making a front end of the rocker arm be in contact with a stem of the intake or exhaust valve; a common chamber for receiving a hydraulic fluid applying a pressure to one of the plungers to maintain a contacting force of the rocker arm and the valve stem; a pair of independent chambers communicated with a hydraulic pressure passage and receiving the hydraulic fluid to supply again the hydraulic fluid exhausted from the common chamber when the valve is lifted; and check ball means disposed between the each independent chamber and the common chamber to supply the hydraulic fluid of the independent chamber for the common chamber.

12 Claims, 3 Drawing Sheets

LASH ADJUSTMENT SYSTEM FOR AN INTERNAL COMBUSTION ENGINE

BACKGROUND OF THE INVENTION

1. Field of the Invention

This invention relates to a lash adjustment system for internal combustion engines and, more particularly, to a lash adjustment system which can adjust valve clearances of intake and exhaust valves by only one lash adjuster.

2. Description of Related Art

In general, valve operations of intake and exhaust valves is achieved by receiving power from a crank shaft.

Valve timing of the intake and exhaust valves has an effect on power of the internal combustion engine. The intake valve opens before an intake stroke of a piston (just before completion of an exhaust stroke) and closes after the piston has passed a bottom dead center of the exhaust stroke.

The reason why the valve operating timing is provided as described above, is because a sufficient mixture can flow into a cylinder by use of an inertia of intake. On the contrary, the exhaust valve opens before completion of a power stroke to quickly exhaust a gas.

In the intake and exhaust valves, each valve clearance is adjusted by a valve train. The valve train includes a cam shaft rotated by power of the engine, a cam shaft floor pressed by a nose of a cam according to the rotating of the cam shaft, and a lash adjuster disposed at an end of the cam shaft floor for adjusting a clearance between a stem end of the valve and the cam shaft floor.

The valve clearance is formed in order to compensate for the thermal expansion in each part of the valve. In general, the valve clearance can be adjusted by an adjusting screw.

However, the valve clearance causes a noise to occur when the engine operates, and in case the adjustment of the valve clearance goes wrong, it causes the mixture in the cylinder to leak out in a state when the intake/exhaust valve closes.

To improve the above-described problems, a hydraulic lash adjuster as a valve clearance control system has been developed and used. Examples are disclosed in U.S. Pat. Nos. 3,805,753, 4,098,240, and 4,788,947.

Each hydraulic lash adjuster is disposed at a cylinder head and has a structure which can apply a force to a predetermined direction with respect to a rocker arm. The adjuster is operated by the oil pressure transmitted through a passage formed in the cylinder head.

In those systems, two hydraulic lash adjusters are disposed respectively on the intake and exhaust valves, for example, in the case of a 4-cylinder combustion engine, eight hydraulic lash adjusters should be used.

When the adjuster is disposed on each intake and exhaust valve as described above, there are problems that a layout of the cylinder head is complicated and costs are increased by installing a large number of components.

SUMMARY OF THE INVENTION

Therefore, the present invention has been made in an effort to solve the above-described problems.

It is an object of the present invention to provide a lash adjusting system for internal combustion engines which can adjust valve clearances of intake and exhaust valves by only one lash adjuster.

To achieve the above objects, the present invention provides a lash adjusting system for a combustion engine having a cylinder head and a valve train for opening or closing an intake valve or an exhaust valve, wherein the system comprises:

- a guide member fixed on the cylinder head and having openings at its both ends;
- a pair of plungers slidably disposed in the guide member, the plungers applying a force in an opposite direction of each other respectively;
- a pair of levers respectively receiving a force from one of the plungers and placing a front end of the rocker arm be in contact with a stem of the intake or an exhaust valve;
- a common chamber for receiving a hydraulic fluid applying a pressure to one of the plungers to maintain a contacting force of the rocker arm and the valve stem;
- a pair of independent chambers communicating with a hydraulic pressure passage and receiving the hydraulic fluid to supply again the hydraulic fluid exhausted from the common chamber when the valve is lifted; and
- check ball means disposed between each independent chamber and the common chamber to supply the hydraulic fluid of the independent chamber for the common chamber.

The valve means comprises:

- a pair of ball members disposed on openings formed in each plunger;
- first and second elastic men, hers applying an elastic force to the ball members respectively to adhere the ball members to the openings, respectively;
- a pair of retainers for supporting the first and second elastic members respectively so that the first and second elastic members can be actively or passively compressed or expanded; and
- a third elastic member for supporting the retainers and preventing the plungers from being abruptly moved.

The plungers are provided with passages respectively whereby the hydraulic fluid in the independent chamber is supplied for the front ends of the lever and plunger respectively for reducing a conflicting resistance which occurs at a contacting portion of the plunger and the lever.

The guide member is provided with a stopper for preventing excessive contact between the rocker arm and the valve stem from occurring by restricting strokes of the plungers.

The front ends of the plungers have a circular arc shape.

Each lever comprises a first prong receiving the force from or transmitting the force to the plunger and a second prong receiving the force from or transmitting the force to the rocker arm.

BRIEF DESCRIPTION OF THE DRAWINGS

Further objects and other advantages of the invention will become apparent from the following description in conjunction with the attached drawings, in which.

DETAILED DESCRIPTION OF THE INVENTION

Figure 1:
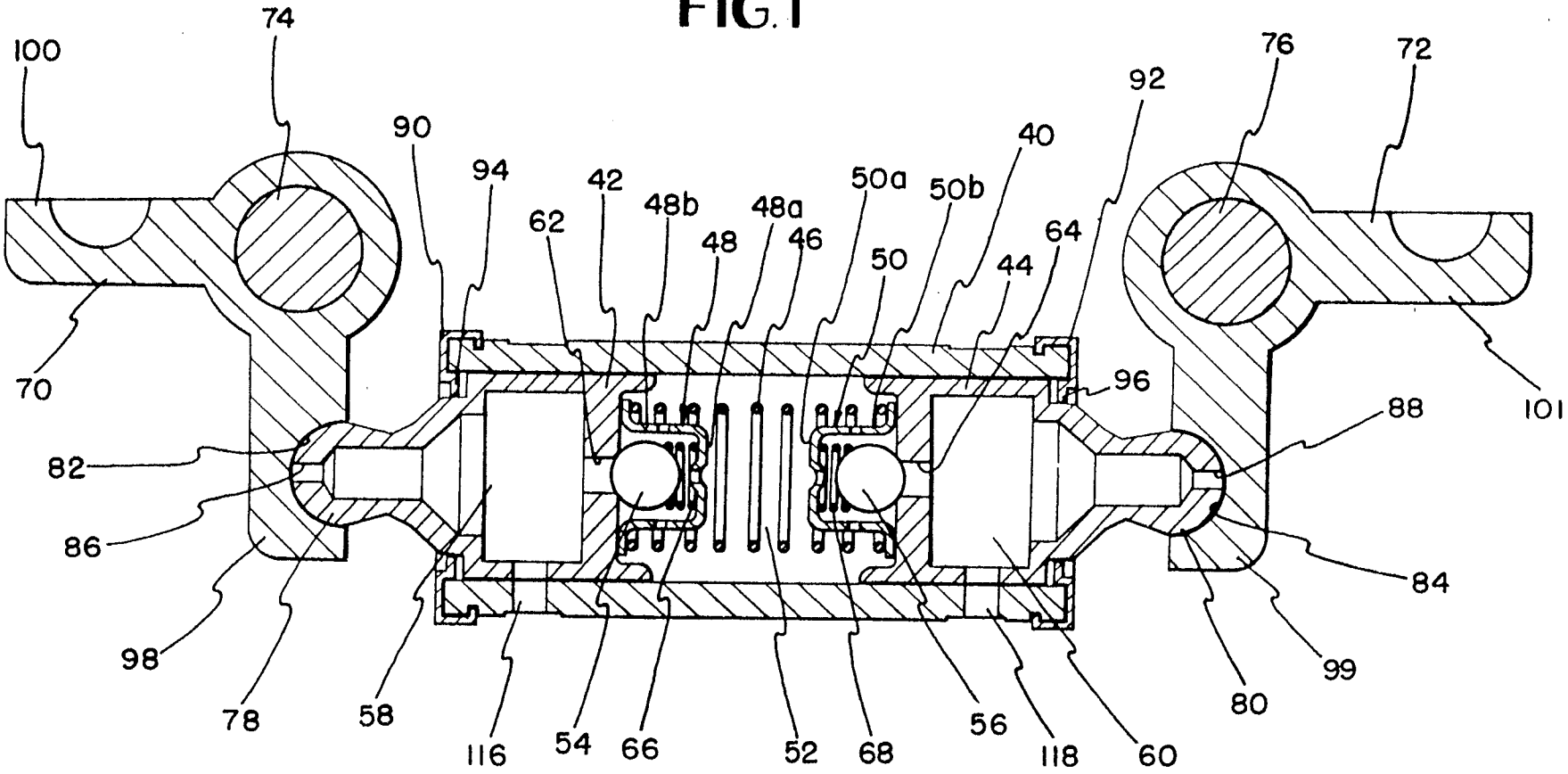
FIG. 1 is a side sectional view of a lash adjusting system in accordance with an embodiment of the present invention.
Figure 2:
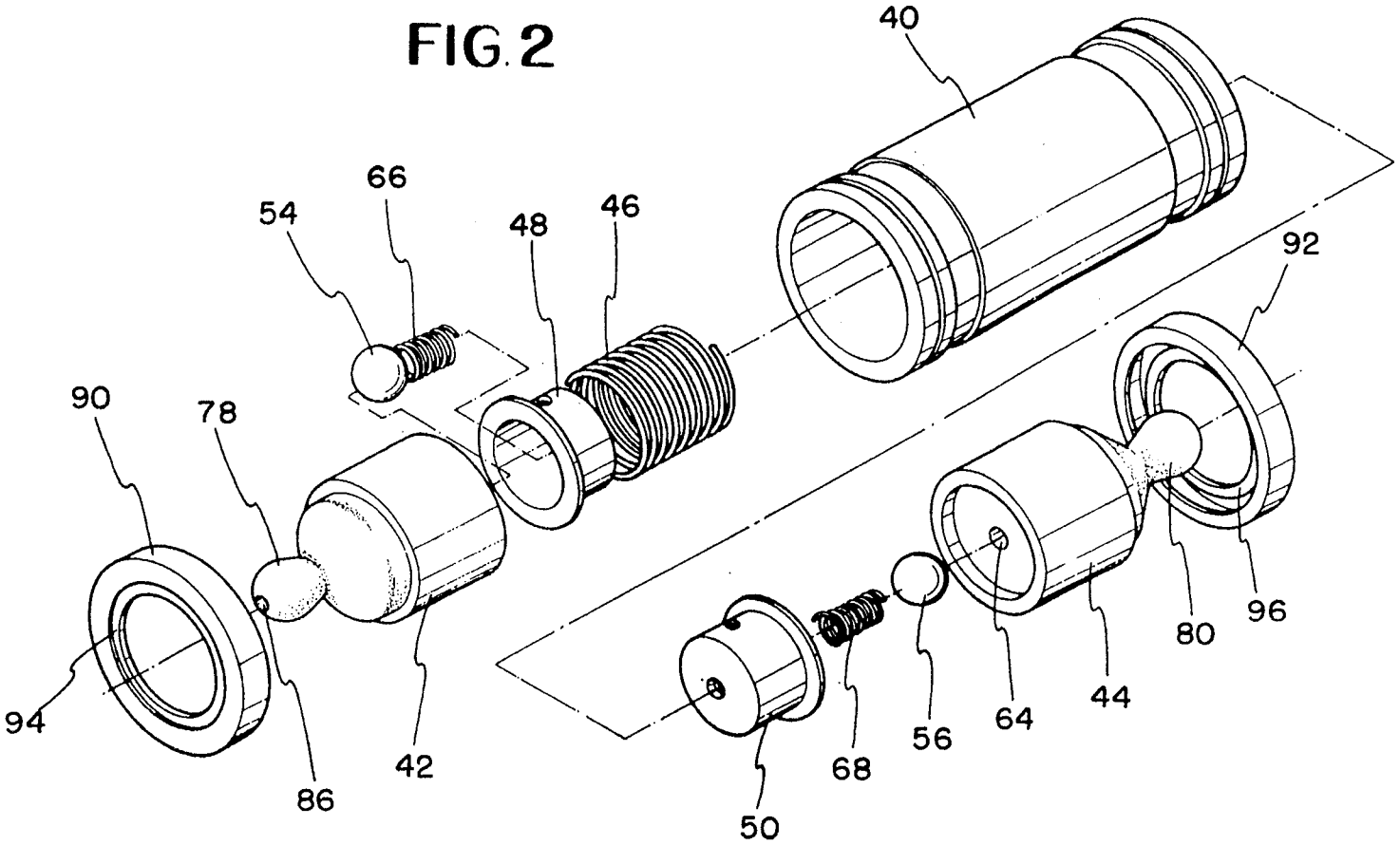
FIG. 2 is an exploded perspective view of a lash adjusting system in accordance with an embodiment of the present invention.

FIGS. 1 and 2 are respectively a side sectional view and an exploded perspective view of a lash adjusting system mounted on a cylinder head (not shown) in accordance with an embodiment of the present invention, in which the system comprises a guide member 40 fixedly mounted on the cylinder head; a first plunger 42 slidably mounted inside the guide member 40; and a second plunger 44 slidably mounted inside the guide member 40 to be opposite to the first plunger 42. Between the first and second plungers 42 and 44, a fluid is accommodated.

There is no sealing member between the guide member 40 and each first and second plunger 42, 44. This is for the fluid to gradually leak out from between the guide member 40 and each plunger 42, 44 when the fluid compressed.

The guide member 40 has a hollow shape and both ends are open. Between the first and second plungers 42, 44, there is a first elastic member 46 having a sufficient force for moving the plungers 42, 44 in an opposite direction with respect to each other.

The first elastic member 46 supports retainers 48, 50 in addition to elastically supporting the plungers 42, 44 such that the retainers 48, 50 can be elastically disposed on the plungers 42, 44, respectively.

The retainers 48 and 50 are facing each other in a common chamber 52 formed between the plungers 42, 44, and the retainers 48, 50 have bottoms 48*a*, 50*a* and walls 48*b*, 50*b* extending from the bottoms 48*a*, 50*a*, respectively.

At the insides of the retainers 48, 50, there are respectively disposed check balls 54, 56. The check balls 54, 56 selectively open and close passages 62, 64 respectively to enable the common chamber 52 to communicate with independent chambers 58, 60 respectively formed at the inner side of the plungers 42, 44, such that an oil flows through the passages 62, 64.

Second and third elastic members 66, 68 having sufficient elastic forces for overcoming gravities of the check balls 54, 56 respectively, are mounted between the inner sides of the retainers 48, 50 and check balls 54, 56, respectively to open and close the passages 62, 64 which are formed on the first and second plungers 42, 44, respectively.

In the above described structure, the first elastic member 46 applies a force against the retainers 48, 50. The second and third elastic members 66, 68 apply the force to the retainers 48, 50 respectively in an opposite direction with respect to the force of the first elastic member. At this point, since the retainers 48, 50 should be closely adhered to the sides of the first and second plungers 42, 44, respectively, the elastic force of the first elastic member 46 should be larger than those of the second and third elastic members 66, 68.

The first and second plungers 42, 44 are movable in opposite directions from each other by a pressure on an inner side of the common chamber and contact first and second levers 70, 72, respectively, whereby the first and second levers 70, 72 absorb the force to rotate about centering axes 74, 76, respectively.

The first and second plungers 42, 44 move rectilinearly and the first and second levers 70, 72 rotate by the rectilinear movements of the first and second plungers 42, 44 respectively, such that friction resistance occurs on contact surfaces of the first and second plungers 42, 44 respectively which come in contact with the first and second levers 70, 72 respectively.

Since the friction resistances have a bad effect on the valve control operation of the present invention, in this embodiment, front ends 78, 80 of the first and second plungers 42, 44 have a round shape, and recesses 82, 84 are formed on the first and second levers 70, 72 respectively which come in contact with the front ends 78, 80 respectively, whereby the rectilinear movement and the rotary movement can be achieved independently from each other.

Further, to reduce the friction resistance, first and second passages 86, 88 are formed on the front ends of the first and second plungers 42, 44, respectively, for a lubricating operation by communicating with the independent chambers 58, 60 respectively.

To prevent the first and second plungers 42, 44 from being broken away from the guide member by an excessive elastic force of the first elastic member 46, first and second stoppers 90, 92 are mounted on both ends of the guide member, respectively.

The first and second levers 70, 72 are rotatably mounted on the centering axes 74, 76, respectively, which are fixedly mounted on the cylinder head. The first and second levers 70, 72 include first prongs 98 and 99 and second prongs 100, 101, respectively.

Figure 3:
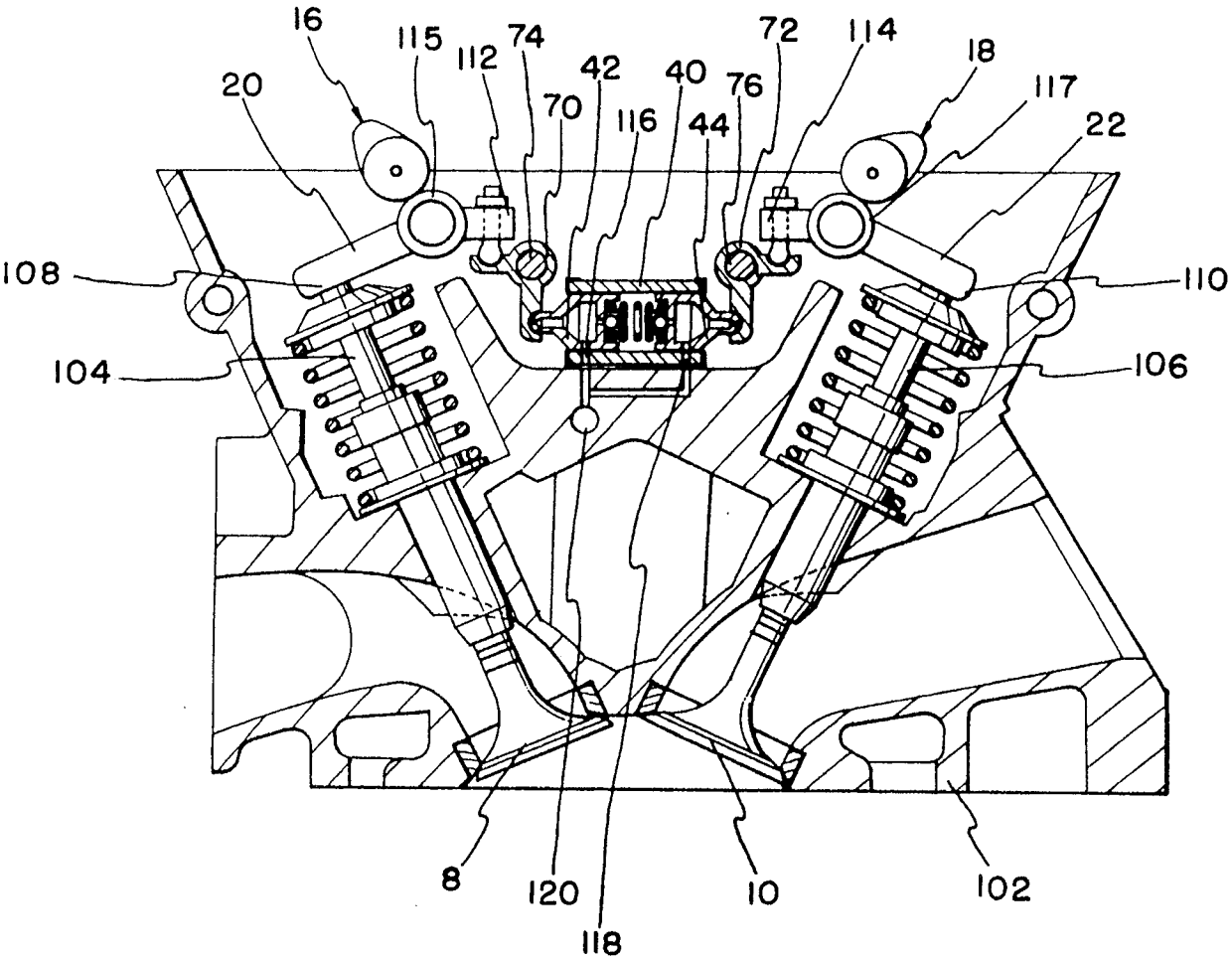
FIG. 3 is a side sectional view of a lash adjusting system mounted on a cylinder head in accordance with an embodiment of the present invention.

The first prongs 98, 99 are extended to a direction in which they can apply a force to or receive a force from the first and second plungers 42, 44, respectively, and the second prongs 100, 101 are extended to a direction in which they can have an effect on or be affected by rocker arms 20, 22 respectively as shown in FIG. 3.

Referring further to FIG. 3, valve stems 104, 106 of the intake and exhaust valves 8, 10 are in contact at their front ends with side ends of the rocker arms 20, 22 respectively.

The rocker arms 20, 22 include first contact ends 108, 110 which are in contact with valve stems 104, 106, respectively, and second contact ends 112, 114 which come in contact with the first and second levers 70, 72 respectively. First and second rollers 115, 117 are rotatably mounted on the rocker arms 20, 22 at portions which come in contact with the intake and exhaust valves respectively to reduce the friction resistance.

Further, in the lash adjustment system of the present invention, the first contact ends 108, 110 maintain a contact state which the upper ends of stems of the intake and exhaust valves 8, 10, while the first contact ends 108, 110 press the upper ends of the stems of the intake and exhaust valves 8, 10 with a predetermined force respectively by being contacted with second contact ends respectively and receiving moving forces from the first and second plunger 42, 44, respectively.

Hydraulic fluid passages 116, 118 are formed in the guide member 40 to supply a hydraulic fluid from oil supply means (not shown) for the independent chambers 58 and 60 through a passage 120 formed on the cylinder head 102, respectively.

In the above described lash adjustment system of the present invention, when the engine operates, the intake and exhaust valves receive a rotating force from the crank shaft and co-rotate with the crank shaft, at this point, when one of noses of the intake cam and exhaust cams 16 and 18 is in contact with one of the rollers 115 and 117, one of the rocker arms 20 and 22 is moved in advance of moving the other rocker arms, whereby one of the intake and exhaust valves opens.

At this point, to describe more in detail if the operating rocker arm relates to the intake valve 8, the second contact end 112 of the rocker arm 20 presses the second prong 100 of the first lever 70 downward such that the lever rotates counterclockwise in the drawing.

By means of the above-described operation, the first prong 98 of the first lever 70 pushes the first plunger 42 toward the second plunger 44 and, at this time, since the second plunger 44 relating to the exhaust valve 10 is in an immovable state, the hydraulic fluid in the common chamber 52 formed between the first plunger 42 and the second plunger 44 receives a compression force, such that the common chamber 52 becomes a high pressure chamber.

However, since a fluid has a property of matter which is not compressed, when the first plunger 42 moves, the hydraulic fluid in the common chamber 52 gradually leaks out from between the guide member 40 and the first plunger 42 so that the pressure of the common chamber is reduced, whereby the first plunger 42 can be moved.

Further, when the intake stroke is completed, and, at the same time, the base circle portion of the intake cam 16 is in contact with the roller 115 of the rocker arm 20, the pressure force applied to the rocker arm 20 is released, such that the intake valve 8 ascends (closes).

Accordingly, the force applied to the second prong 100 of the first lever 70 is released, whereby since the elastic force of the first elastic member 40 compressed while the first plunger 42 moves is applied to the first plunger 42, the first plunger moves in an opposite direction of a direction of when the intake stroke is initiated, that is, moves leftward in the drawing. Further, since the common chamber 52 is in a state where the pressure is substantially less than that of the independent chamber 58, the check ball 54 receives a moving force toward the common chamber 52 by the hydraulic fluid of the independent chamber 58.

Thus, the hydraulic fluid in the independent chamber 58 is moved toward the common chamber 52 while the passage formed in the first plunger opens.

At this point, the check ball 54 moves again leftward and closes the passage 62 while the pressure in the common chamber 52 becomes larger than that of the independent chamber 58. Thus, since pressure in the common chamber 52 is increased and the force applied to the first plunger 42 is released, the first plunger moves leftward and transmits the rotating power clockwise with respect to the first lever 70.

By the above described operation, the second prong 100 of the first lever 70 always maintains a predetermined clearance of the intake valve 8 by being in contact with an upper end of the valve stem 104 and does not interfere with ascending of the intake valve 8.

Although the above described operation relates to the intake side, such operation occurs in the exhaust side in the same manner, such that the present invention has an advantage that the clearances between the each upper end of the stem and each rocker arm of the intake and exhaust valves can be regularly maintained by only one control system.

Another advantage of the present invention is that since only one adjustment system is used, a layout of the cylinder head is simplified and cost is reduced by a little component.

Although preferred embodiments of the present invention have been described in detail hereinabove, it should be clearly understood that many variations and/or modifications of the basic inventive concepts herein taught which may appear to those skilled in the pertinent art will still fall within the spirit and scope of the appended claims.

What is claimed is:

1. A lash adjustment system for a combustion engine having a cylinder head and a valve train for opening and closing an intake valve and an exhaust valve, the combination thereof comprising:

a guide member fixed on the cylinder head and having openings at opposing ends thereof;

a pair of plungers slidably disposed in said guide member, the plungers applying a force in opposite directions from each other, respectively;

a pair of levers respectively receiving a force from one of the plungers and selectively forcing a front end of a rocker arm into contact with a stem of the respective intake and exhaust valve;

a common chamber for receiving a hydraulic fluid and applying a pressure to one of the plungers to maintain a contacting force of the rocker arm and the valve stem;

a pair of independent chambers communicating with a hydraulic pressure passage and receiving the hydraulic fluid to supply again the hydraulic fluid exhausted from the common chamber when the valve is lifted; and check ball means disposed between each independent chamber and the common chamber to supply the hydraulic fluid of the independent chamber to the common chamber.

2. The lash adjustment system according to claim 1, further comprising valve means formed within said guide member for selectively directing fluid wherein the valve means includes:

a pair of ball members disposed on openings formed in each plunger;

first and second elastic members applying an elastic force to the ball members respectively to adhere the ball members to the openings respectively;

a pair of retainers for supporting the first and second elastic members respectively so that the first and second elastic members can be compressed and expanded; and a third elastic member for supporting the retainers and preventing the plungers from being abruptly moved.

3. The lash adjustment system according to claim 1, wherein the plungers are provided with passages respectively whereby the hydraulic fluid in the independent chamber is supplied for front ends of the lever and plunger respectively for reducing a conflicting resistance occurring at a contacting portion of the plunger and the lever.

4. The lash adjustment system according to claim 1, wherein said guide member is provided with a stopper for preventing excessive contact between the rocker arm and the valve stem from occurring by restricting strokes the plungers.

5. The lash adjustment system according to claim 1, wherein front ends of the plungers have a circular arc shape.

6. The lash adjustment system according to claim 1, wherein each lever comprises: a first prong receiving the force from and transmitting the force to the plunger and a second prong receiving the force from and transmitting the force to the rocker arm.

7. A lash adjustment system for a combustion engine comprising:

a pair of levers rotating respectively in accordance with moving directions of rocker arms which cooperate with opening and closing operations of intake and exhaust valves;

a pair of plungers, one of said plungers being moved by one of said levers when one of said valves opens, the other plunger being fixedly supported by the other lever when one of said valves closes;

a guide member for guiding one of said plungers to move toward the other plunger which is fixedly supported by one of said levers;

a common chamber gradually changed into a high pressure chamber by leaking out a fluid receiving a compression force by a movement of one of said plungers through between the plunger and the guide member;

independent chambers communicating with hydraulic fluid supplying means respectively for supplying the hydraulic fluid for the common chamber which is changed into a low pressure chamber by increasing a volume of the common chamber by moving the plunger compressing the hydraulic fluid outward when the valve opens;

check ball means disposed between the common chamber and the independent chambers respectively for opening a passage to move the hydraulic fluid of the independent chambers toward the common chamber in accordance with variation of the common chamber's pressure; and an elastic member disposed between plungers and saving an elastic force when one of the plungers moves to a compression direction and then moves the plunger in an expanding direction.

8. The lash adjustment system according to claim 7, wherein said check ball means comprises:

a pair of ball members disposed on openings formed in the first and second plungers respectively;

first and second elastic members applying an elastic force to the ball members respectively to adhere the ball members to the openings respectively;

a pair of retainers for supporting the second and third elastic members respectively so that the first and second elastic members can be compressed and expanded; and a third elastic member for supporting the retainers and preventing the pair of plungers from being abruptly moved.

9. The lash adjustment system according to claim 7, wherein the plungers are provided with passages whereby the hydraulic fluid in the independent chamber is supplied for front ends of the lever and plunger respectively for reducing a conflicting resistance occurring at a contacting portion of the plunger and the lever.

10. The lash adjustment system according to claim 7, wherein the guide member is provided with a stopper for preventing the excessive contact between the rocker arm and the valve stem from occurring by restricting strokes of the plungers.

11. The lash adjustment system according to claim 7, wherein the front ends of the plungers are formed with a circular arc shape.

12. The lash adjustment system according to claim 7, wherein each lever comprises: a first prong receiving the force from and transmitting the force to the plunger and a second prong receiving the force from and transmitting the force to the rocker arm.

* * * * *